US007165622B2

(12) United States Patent
Hirth et al.

(10) Patent No.: US 7,165,622 B2
(45) Date of Patent: Jan. 23, 2007

(54) PACKER WITH METAL SEALING ELEMENT

(75) Inventors: David Eugene Hirth, Pasadena, TX (US); Tarald Gudmestad, Naerbo (NO)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/158,184

(22) Filed: Jun. 21, 2005

(65) Prior Publication Data

US 2005/0230100 A1 Oct. 20, 2005

Related U.S. Application Data

(63) Continuation of application No. 10/438,763, filed on May 15, 2003.

(51) Int. Cl.
*E21B 33/12* (2006.01)
*E21B 33/13* (2006.01)

(52) U.S. Cl. ..... 166/387; 166/118; 166/138; 277/339

(58) Field of Classification Search ..... 166/387, 166/118, 138, 134, 120; 277/339
See application file for complete search history.

(56) References Cited

U.S. PATENT DOCUMENTS 4,573,537 A 3/1986 Hirasuna et al.
4,702,481 A 10/1987 Brammer
4,719,971 A 1/1988 Owens
4,842,061 A 6/1989 Nobileau
4,995,464 A 2/1991 Watkins et al.
5,096,209 A 3/1992 Ross
5,333,692 A 8/1994 Baugh et al.
5,511,620 A 4/1996 Baugh et al.
6,142,227 A 11/2000 Hiorth et al.
6,431,275 B1 8/2002 Turley
6,446,717 B1 9/2002 White et al.
6,962,206 B1 * 11/2005 Hirth et al. ..... 166/387

FOREIGN PATENT DOCUMENTS

RU 2 083 798 C1 7/1997

OTHER PUBLICATIONS

U.K. Search Report, Application No. GB0410879.1, dated Sep. 6, 2004.
GB Search Report, Application No.: 0410879.1, Dated Aug. 15, 2006.

* cited by examiner

*Primary Examiner*—Kenneth Thompson
(74) *Attorney, Agent, or Firm*—Patterson & Sheridan, LLP

(57) ABSTRACT

A packer, and operation of the same, which forms elastomeric seals and non-elastomeric seals. The packer may be constructed from a non-elastomeric tubular core having a frustoconical shaped inner diameter. The outer diameter of the core may be substantially smooth and carry one or more elastomeric sealing elements. The packer is set by causing the diametrical expansion of the tubular core. The construction of the tubular core is preferably such that its diametrical expansion causes the formation of radial raised portions (upsets) on the outer surface. These raised portions form the non-elastomeric seals and also prevent extrusion of the elastomeric sealing elements.

23 Claims, 7 Drawing Sheets

PACKER WITH METAL SEALING ELEMENT

CROSS-REFERENCE TO RELATED APPLICATIONS

This application is a continuation of U.S. patent application Ser. No. 10/438,763, filed May 15, 2003 now U.S. Pat. No. 6,962,260. The aforementioned related patent application is herein incorporated by reference in its entirety.

BACKGROUND OF THE INVENTION

1. Field of the Invention

Embodiments of the present invention generally relate to a downhole tool, and more particularly to packers.

2. Description of the Related Art

In the oilfield industry packers are employed at different stages and can be generally classified by application, setting method and retrievability. A principal function is to seal an annular area formed between two co-axially disposed tubulars within a wellbore. A packer may seal, for example, an annulus formed between production tubing disposed within wellbore casing. Alternatively, some packers seal an annulus between the outside of a tubular and an unlined borehole. Routine uses of packers include the protection of casing from pressure, both well and stimulation pressures, and protection of the wellbore casing from corrosive fluids. Other common uses may include the isolation of formations or of leaks within wellbore casing, squeezed perforation, or multiple producing zones of a well, thereby preventing migration of fluid or pressure between zones. Packers may also be used to hold kill fluids or treating fluids in the casing annulus.

Packers may be run on wireline (a medium for propagating signals between a surface unit and downhole location), pipe or coiled tubing. In each case, the packer includes a setting mechanism which operates to set a sealing element. The type and operation of the setting mechanism and related sealing element may depend on whether the packer is to be set permanently or temporarily (i.e., to be retrieved at a later time). Conventional packers typically include a sealing element (i.e., an elastomeric element) between upper and lower retaining rings or elements. The sealing element is compressed to radially expand the sealing element outwardly into contact with the well casing therearound, thereby sealing the annulus. Alternatively, the expansion of the sealing element may be accomplished by pumping a fluid into a bladder.

As recoverable petroleum reserves are being found at ever increasing depths, packers are required to operate in environments of corresponding higher temperatures and pressures. Packers typically rely on a series of backup rings and support components to contain the elastomer sealing element and prevent extrusion (i.e., migration of the sealing element beyond the defined containment area). Unfortunately, the higher temperatures associated with deeper subterranean operations soften the elastomer sealing elements and lessen their ability to resist extrusion. With increasing temperatures and pressures, all of the interfaces between the backups and support components become potential extrusion gaps for the sealing element.

A particular operation during which conventional packers often fail is when installing liners. It is common practice to place a packer at the liner lap to provide a mechanically formed seal in addition to the seal created by the cement. The sealing elements of such packers are typically tubular shaped sections of elastomer that are slid over a mandrel.

The sealing elements are typically activated by applying a compressive force to radially expand the sealing element outwardly into contact with the well casing, as described above. When pumping cement during liner cementing operations, it is desirable to pump at high rates in order to provide a more effective washing action to clean out wellbore debris and prevent channeling of the cement. These high flow rates can cause a low-pressure zone over the unset sealing element of the packer. In addition, higher temperatures cause the elements to expand and become softer, thereby lessening their stability. Under these conditions, conventional elastomer sealing elements may become unstable and swab off, preventing the cementing operations from being completed as desired and possibly damaging the sealing element.

Another downhole condition which detrimentally effects the operation of a sealing element is the interface between casing and the backup rings designed to contain the sealing element. The casing surface that the backup rings contact is typically a rough rolled surface that may be somewhat irregular. In addition, most conventional backup rings are triangular in shape with one of the legs of the triangle contacting the inner casing surface. The angle of the support pieces that urge the backup rings out is typically between about 45 and 60 degrees with respect to the axial centerline of the packer. The relatively irregular contact surface of the casing combined with the angle of the support pieces provides a modest contact force between the backup and the casing. This contact force is often insufficient to contain the sealing element, particularly at elevated temperatures and pressures.

Therefore, there is a need for packers having sufficient pressure integrity for both liquidity and gas, particularly for various high temperature and/or high pressure environments.

SUMMARY OF THE INVENTION

The present invention generally relates to a packer and method of setting the same.

One aspect of the invention provides a packer for downhole sealing operations, where the packer includes a tubular body having an outer surface and an elastomeric sealing element disposed on a seal-carrying portion of the outer surface. The tubular body includes a pair of annular portions each having a radial dimension and each forming a separate actuator-contact surface at an inner diameter and a pair of annular non-elastomeric sealing surfaces which form a part of the outer surface. The seal-carrying portion is disposed between the non-elastomeric sealing surfaces and a void is formed between an inner surface of the seal-carrying portion and the annular members. The body is adapted to be placed in a sealed position, from an unsealed position, upon application of a force to the actuator-contact surfaces, thereby causing deformation of the seal-carrying portion into the void at least until the pair of non-elastomeric sealing surfaces make contact with a wellbore tubular surface.

Another aspect provides a packer for downhole sealing operations, where the packer includes a non-elastomeric tubular body forming a substantially smooth outer surface at an outer diameter, wherein a portion of the outer surface defines at least three non-elastomeric sealing surfaces comprising a first non-elastomeric sealing surface at a first end of the outer surface, a second non-elastomeric sealing surface at a second end of the outer surface and a third non-elastomeric sealing surface between the first and second non-elastomeric sealing surfaces. The packer further includes a pair of annular support ribs at each end of the tubular body, each having one of the at least three non-elastomeric sealing surfaces disposed at their respective diametrically outer ends and each defining a separate actuator-contact surface at an inner diameter; whereby at least one void is formed between the annular support ribs. A first elastomeric sealing element is disposed on the substantially smooth outer surface and between the first non-elastomeric sealing surface and the third non-elastomeric sealing surface; and a second elastomeric sealing element is disposed on the substantially smooth outer surface and between the second non-elastomeric sealing surface and the third non-elastomeric sealing surface, whereby the first and second elastomeric sealing elements are separated by the third non-elastomeric sealing surface. The non-elastomeric tubular body is adapted to be placed in a sealed position, from an unsealed position, upon application of a force to the actuator-contact surface causing deformation of the substantially smooth outer surface into the void at least until the non-elastomeric sealing surfaces make contact with a wellbore tubular surface.

Yet another aspect provides a packer for downhole sealing operations, comprising a non-elastomeric tubular body forming a substantially smooth outer surface at an outer diameter, wherein a portion of the outer surface defines at least three non-elastomeric sealing surfaces comprising a first non-elastomeric sealing surface at a first end of the outer surface, a second non-elastomeric sealing surface at a second end of the outer surface and a third non-elastomeric sealing surface between the first and second non-elastomeric sealing surfaces. A pair of annular ribs is at each end of the tubular body, each having one of the first and second non-elastomeric sealing surfaces disposed at their respective diametrical outer ends and each defining a separate actuator-contact surface at an inner diameter; whereby at least one void is formed between the annular ribs. A first elastomeric sealing element is disposed on the substantially smooth outer surface and between the first non-elastomeric sealing surface and the third non-elastomeric sealing surface and a second elastomeric sealing element is disposed on the substantially smooth outer surface and between the second non-elastomeric sealing surface and the third non-elastomeric sealing surface, whereby the first and second elastomeric sealing elements are separated by the third non-elastomeric sealing surface. An annular sealing rib is disposed on the tubular body and extending radially inwardly into the void from the outer surface of the tubular body, the sealing rib carrying a seal on its diametrically inner surface. A pair of annular support members are each disposed on the tubular body below one of the elastomeric sealing elements and extending radially inwardly from the outer surface and into the void and each having an inner diameter larger than a smallest diameter defined by the actuator-contact surfaces; wherein the annular support members limit the degree of deformation of the substantially smooth outer surface and transmit an applied force to an interface between the elastomeric sealing elements and wellbore tubular surface when the packer is in a sealed position. The packer is adapted to be placed in the sealed position, from an unsealed position, upon application of a force to the actuator-contact surface causing deformation of the substantially smooth outer surface into the void at least until the non-elastomeric sealing surfaces make contact with a wellbore tubular surface.

Still another aspect provides a method of forming a seal with respect to a casing disposed in a wellbore. The method includes providing a packer comprising a substantially tubular body defining a substantially cylindrical outer surface; a pair of annular ribs extending radially inwardly and each defining a lower actuation surface and an upper sealing surface and a sealing rib. The lower actuation surfaces of the annular ribs define a frustoconical inner diameter and the upper sealing surfaces form a part of the outer surface of the tubular member, and wherein at least one annular void is defined between the pair of annular ribs and the outersurface to accommodate a degree of deformation of the outer surface. The sealing rib extends radially inwardly into the void from the outer surface of the tubular body and carries a seal on its diametrically inner surface. The method further comprises running the packer into the wellbore, and diametrically expanding the packer by application of a force to the respective lower actuation surfaces of the annular ribs, whereby the upper sealing surfaces of the annular ribs contact an inner diameter of the casing to form respective independent non-elastomeric seals; and wherein, in a set position, the outer surface of the tubular member is deformed relative to a condition of the outer surface in an unset position.

Yet another aspect provides a method of forming a seal on an inner diameter of a casing disposed in a wellbore. The seal is formed by a packer comprising (i) a substantially tubular body defining a substantially cylindrical outer surface and further defining at least one annular void to accommodate a degree of deformation of the outer surface; (ii) a sealing rib extending radially inwardly into the void from the outer surface, the sealing rib carrying a seal on its diametrically inner surface; and (iii) at least two elastomeric sealing elements disposed on the outer surface, wherein at least three annular portions of the outer surface remain exposed. The method comprises running the packer into the wellbore; and diametrically expanding the packer by application of a force to selected portions of the tubular body until the packer is placed in a set position in which the at least three annular portions of the outer surface form independent annular non-elastomeric seals on the inner diameter of the casing and wherein the elastomeric sealing elements form elastomeric seals between the independent annular non-elastomeric seals to prevent the elastomeric sealing elements from extruding beyond the non-elastomeric seals, whereby the outer surface of the tubular member, where the elastomeric sealing elements reside, is deformed relative to a condition of the outer surface in an unset position.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention generally relates to a packer configured to form elastomeric seals and non-elastomeric seals. The packer may be constructed from a non-elastomeric tubular core having a frustoconical shaped inner diameter. The outer diameter of the core may be substantially smooth and carry one or more elastomeric sealing elements. The packer is set by causing the diametrical expansion of the tubular core. The construction of the tubular core is preferably such that its diametrical expansion causes the formation of radial raised portions (upsets) on the outer surface. These raised portions form the non-elastomeric seals and also prevent extrusion of the elastomeric sealing elements.

Figure 1:
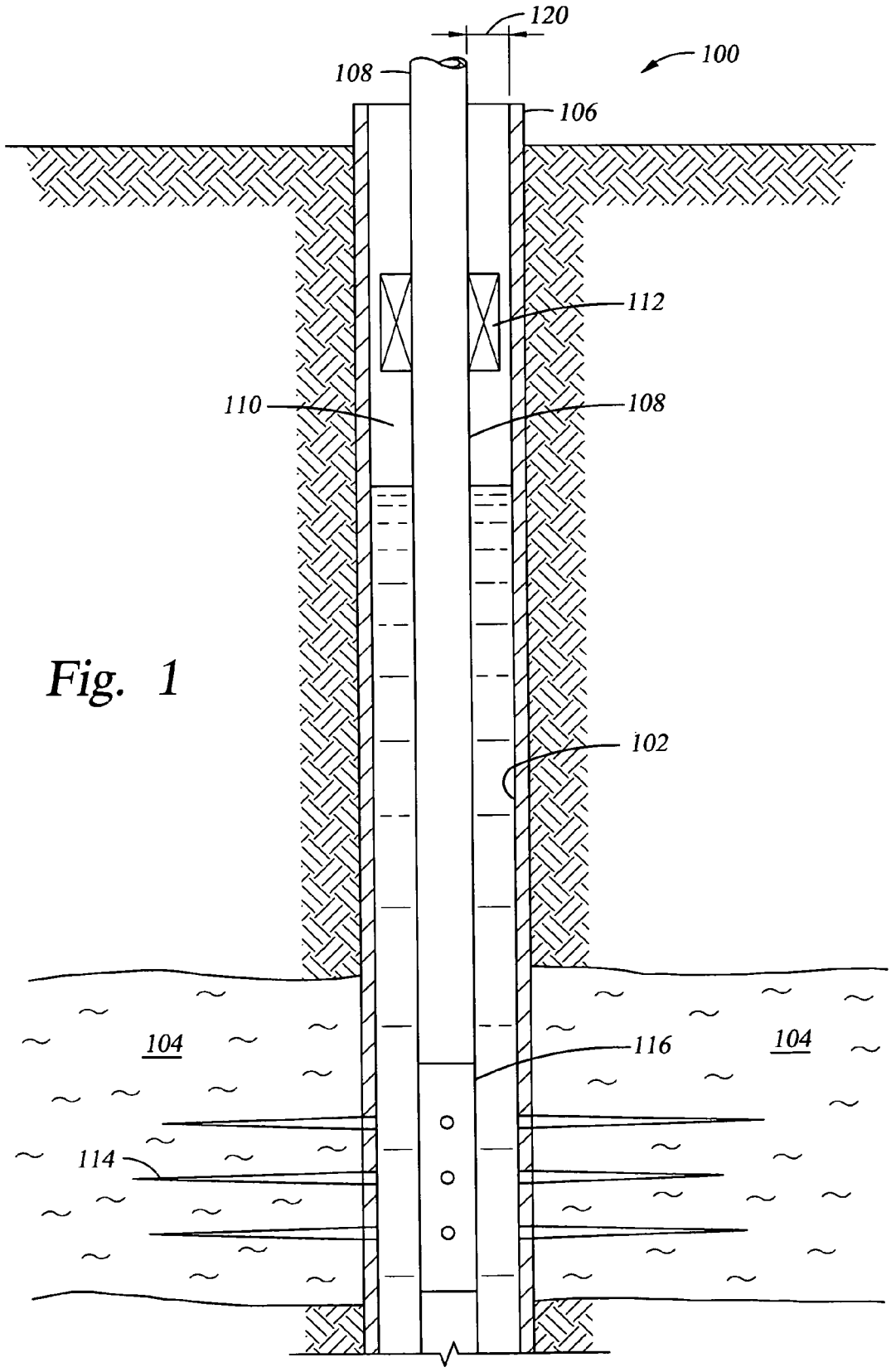
FIG. 1 is a side view of a tubing string in a wellbore lined with casing, wherein the tubing string is made up with a packer.

FIG. 1 is a cross-sectional view of a typical subterranean hydrocarbon well 100 that defines a vertical wellbore 102. The well 100 has multiple hydrocarbon bearing formations, such as oil-bearing formation 104 and/or gas bearing formations (not shown). In addition to the vertical wellbore 102, the well 100 may include a horizontal wellbore (not shown) to more completely and effectively reach formations 104 bearing oil or other hydrocarbons.

In FIG. 1, wellbore 102 has a casing 106 disposed therein. After wellbore 102 is formed and lined with casing 106, a tubing string 108 is run into the opening 110 formed by the casing 106 to provide a pathway for hydrocarbons to the surface of the well 100.

Hydrocarbons may be recovered by forming perforations 114 in the formations 104 to allow hydrocarbons to enter the casing opening 110. In the illustrative embodiment, the perforations 114 are formed by operating a perforation gun 116, which is a component of the tubing string 108. The perforating gun 116 may be activated either hydraulically or mechanically and includes shaped charges constructed and arranged to perforate casing 106 and the formations 104 to allow the hydrocarbons trapped in the formations 104 to flow to the surface of the well 100.

Figure 2:
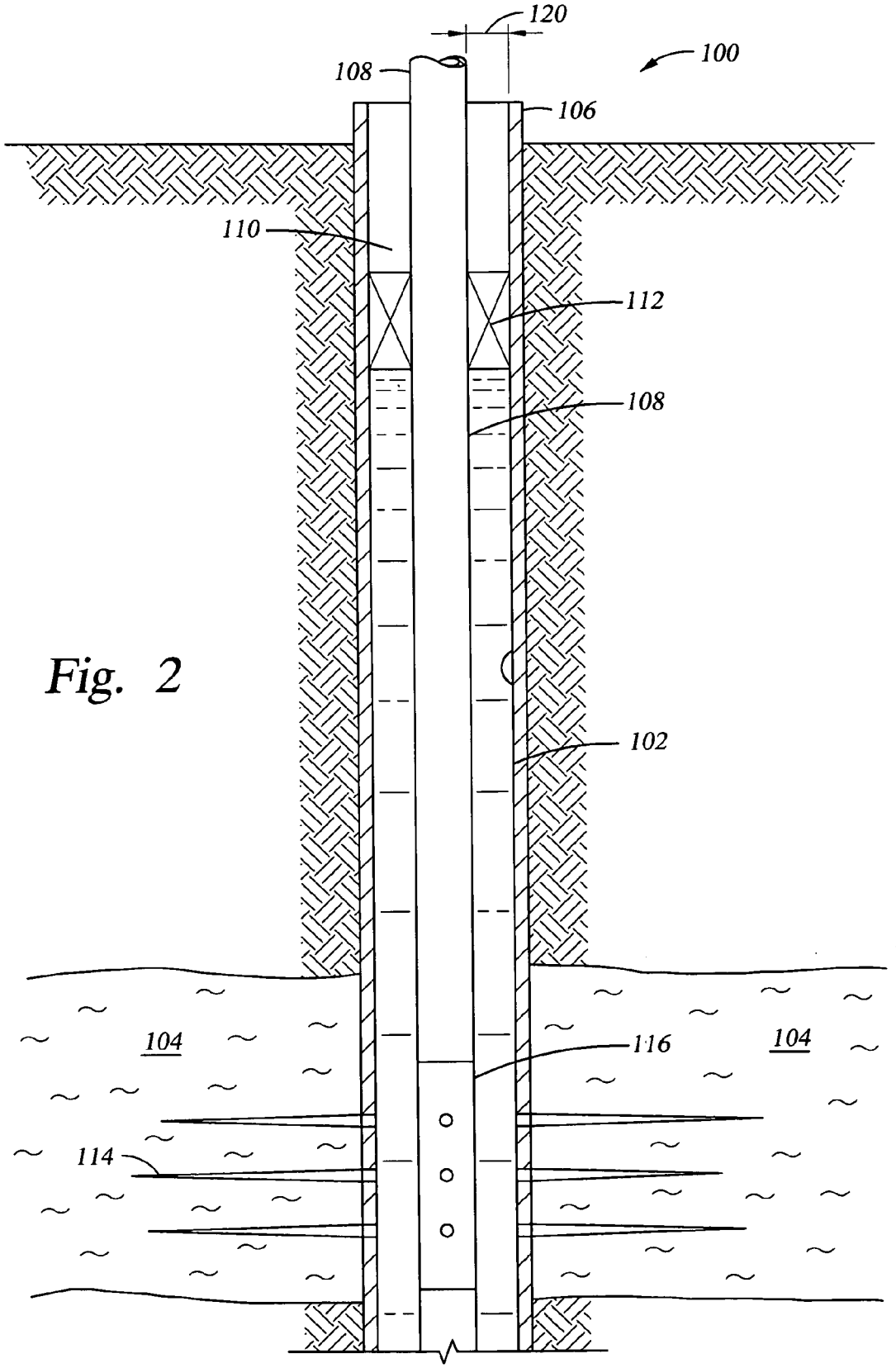
FIG. 2 is a side view of the tubing string of FIG. 1 and showing the packer in a set position.

The tubing string 108 also carries, or is made up of, an un-set packer 112. Although generically shown as a singular element, the packer 112 may be an assembly of components operably connected to one another. Generally, the packer 112 may be operated by hydraulic or mechanical means and is used to form a seal at a desired location in the wellbore 102. The packer 112 may seal, for example, an annular space 120 formed between production tubing 108 and the wellbore casing 106, as is shown in FIG. 2. Alternatively, the packer 112 may seal an annular space between the outside of a tubular and an unlined wellbore. Common uses of the packer 112 include protection of the casing 106 from pressure and corrosive fluids; isolation of casing leaks, squeezed perforations, or multiple producing intervals; and holding of treating fluids, heavy fluids or kill fluids. However, these uses for the packer 112 are merely illustrative and application of the packer 112 is not limited to only these uses.

It is understood that the tubular string 108 shown in FIGS. 1 and 2 is merely one configuration of a tubular string comprising the packer 112. Persons skilled in the art will recognize that many configurations within the scope of the invention are possible.

Referring now to FIG. 3, a portion the tubing string 108 is shown in cross section to illustrate one embodiment of the packer 112 in a run-in (unset) position. Illustratively, the tubing string 108 includes a mandrel 302 which defines an inner diameter of the depicted portion of the tubing string 108. An actuator sleeve 304 is slidably disposed about at least a portion of the mandrel 302. The mandrel 302 and the actuator sleeve 304 define a sealed interface by the provision of an O-ring ring 306, illustratively carried on an outer diameter of the mandrel 302. A terminal end of the actuator sleeve 304 is shouldered against a wedge member 308. The wedge member 308 is generally cylindrical and slidably disposed about the mandrel 302. An O-ring 310 is disposed between the mandrel 302 and the wedge member 308 to form a sealed interface therebetween. Illustratively, the O-ring 310 is carried on the inner surface of the wedge member 308; however, the O-ring 310 may also be carried on the outer surface of the mandrel 302.

Preferably, the packer 112 includes a locking mechanism which allows the wedge member 308 to travel in one direction and prevents travel in the opposite direction. In the illustrative embodiment, the locking mechanism is implemented as a ratchet ring 312 disposed on a ratchet surface 314 of the mandrel 302. The ratchet ring 312 is recessed into, and carried by, the wedge member 308. In this case, the interface of the ratchet ring 312 and the ratchet surface 314 allows the wedge member 308 to travel only in the direction of the arrow 315.

A portion of the wedge member 308 forms an outer tapered surface 316. In operation, the tapered surface 316 forms an inclined glide surface for a packing element 318. Accordingly, the wedge member 308 is shown disposed between the mandrel 302 and packing element 318, where the packing element 318 is disposed on the tapered surface 316. In the depicted run-in position, the packing element 318 is located at a tip of the wedge member 308, the tip defining a relatively smaller outer diameter with respect to the other end of the tapered surface 316.

Illustratively, the packing element 318 is held in place by a retaining sleeve 320. Any variety of locking interfaces may be used to couple the sealing element 318 with the retaining sleeve 320. In the illustrative embodiment, the retaining sleeve 320 includes a plurality of collet fingers 322. In an illustrative embodiment, 16 collet fingers 322 are provided. The terminal ends of the collet fingers 322 are interlocked with an annular lip of the packing element 318. In one embodiment, the collet fingers 322 may be biased in a radial direction. For example, it is contemplated that the collet fingers 322 have outward radial bias urging the collet fingers 322 into a flared or straighter position. However, in this case the collet fingers 322 do not provide a sufficient force to cause expansion of the packing element 318.

Preferably, the packer 112 includes a self-adjusting locking mechanism which allows the retaining sleeve 320 to travel in one direction and prevents travel in the opposite direction. In the illustrative embodiment, the locking mechanism is implemented as a ratchet ring 326 disposed on a ratchet surface 328 of the mandrel 302. The ratchet ring 326 is recessed into, and carried by, the retaining sleeve 320. In this case, the interface of the ratchet ring 326 and the ratchet surface 328 allows the retaining sleeve 320 to travel only in the direction of the arrow 330, relative to the mandrel 302. As will be described in more detail below, this self-adjusting locking mechanism ensures that a sufficient seal is maintained by the packing element 318 despite counter-forces acting to subvert the integrity of seal.

Figure 3A:
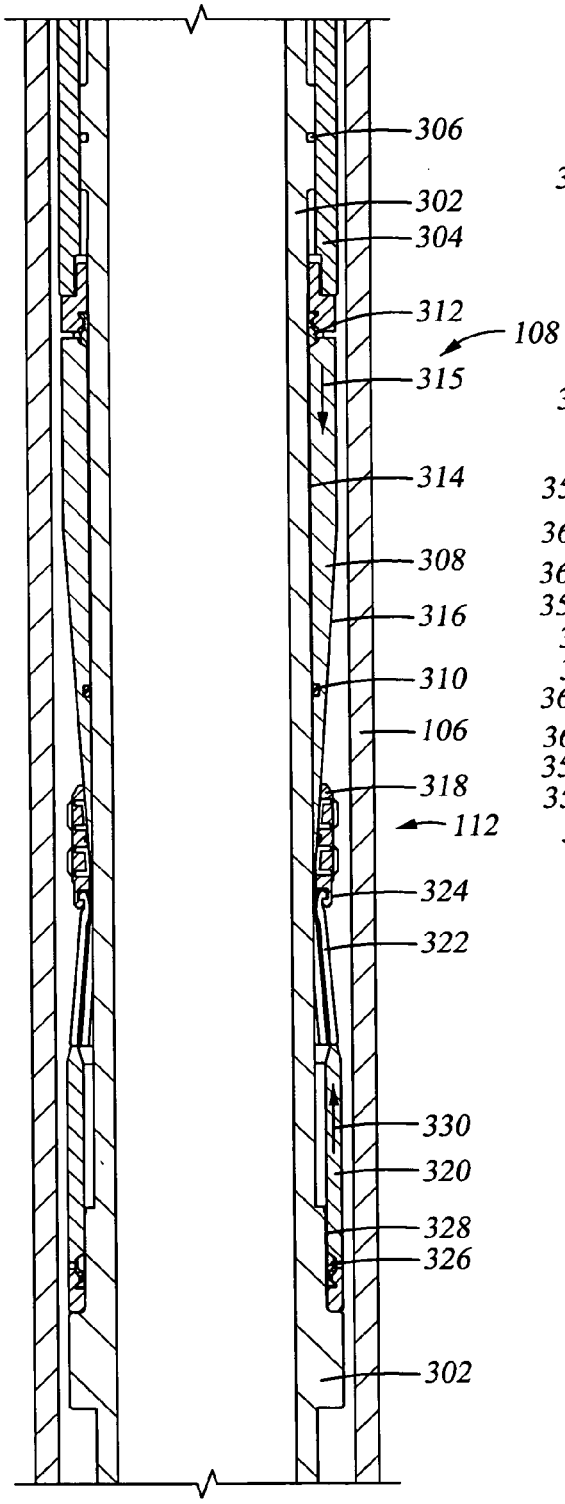
FIG. 3A is a side cross sectional view of the tubing string of FIG. 1 showing one embodiment of the packer in an unset position.
Figure 4A:
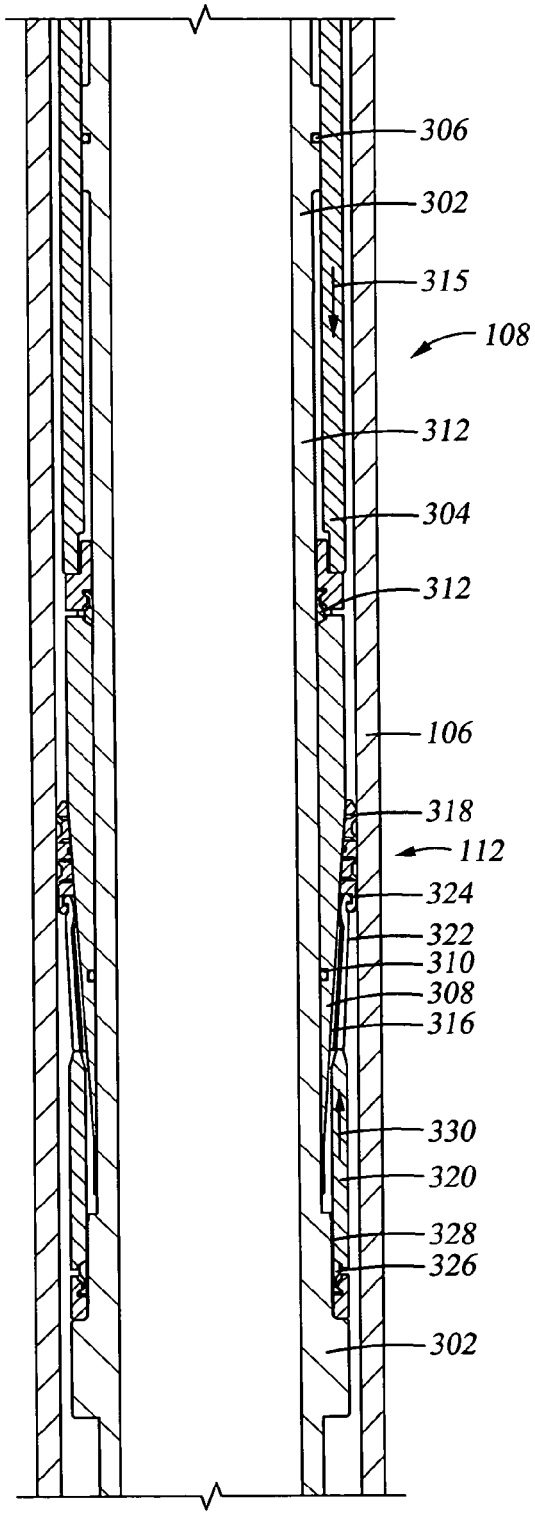
FIG. 4A is a side cross sectional view of the tubing string of FIG. 1 showing one embodiment of the packer in a set position.

In operation, the packer 112 is run into a wellbore in the run-in position shown in FIG. 3A. To set the packer 112, the actuator sleeve 304 is driven axially in the direction of the arrow 315. The axial movement of the actuator sleeve 304 may be caused by, for example, applied mechanical force from the weight of a tubing string, hydraulic pressure acting on a piston. The actuator sleeve 304, in turn, engages the wedge member 308 and drives the wedge member 308 axially along the outer surface of the mandrel 302. As noted above, a locking mechanism made up of the ratchet ring 312 and the ratchet surface 314 ensures that the wedge member 308 travels only in the direction of the arrow 315. With continuing travel over the mandrel 302, the wedge member 308 is driven underneath the packing element 318. The packing element is prevented from moving with respect to the wedge member 308 by the provision of the ratchet ring 326 and the ratchet surface 328. As a result, the packing element 318 is forced to slide over the tapered surface 316. The positive inclination of the tapered surface 316 urges the packing element 318 into a diametrically expanded position. The terminal, set position of the packer 112 is shown in FIG. 4A. In this position, the packing element 318 rests at an upper end of the tapered surface 316 and is urged into contact with the casing 106 to form a fluid-tight seal. As will be described in more detail below, the fluid-tight seal is formed in part by a metal-to-elastomer seal and a metal-to-metal seal. More generally, the metal may be any non-elastomer.

Figure 5:
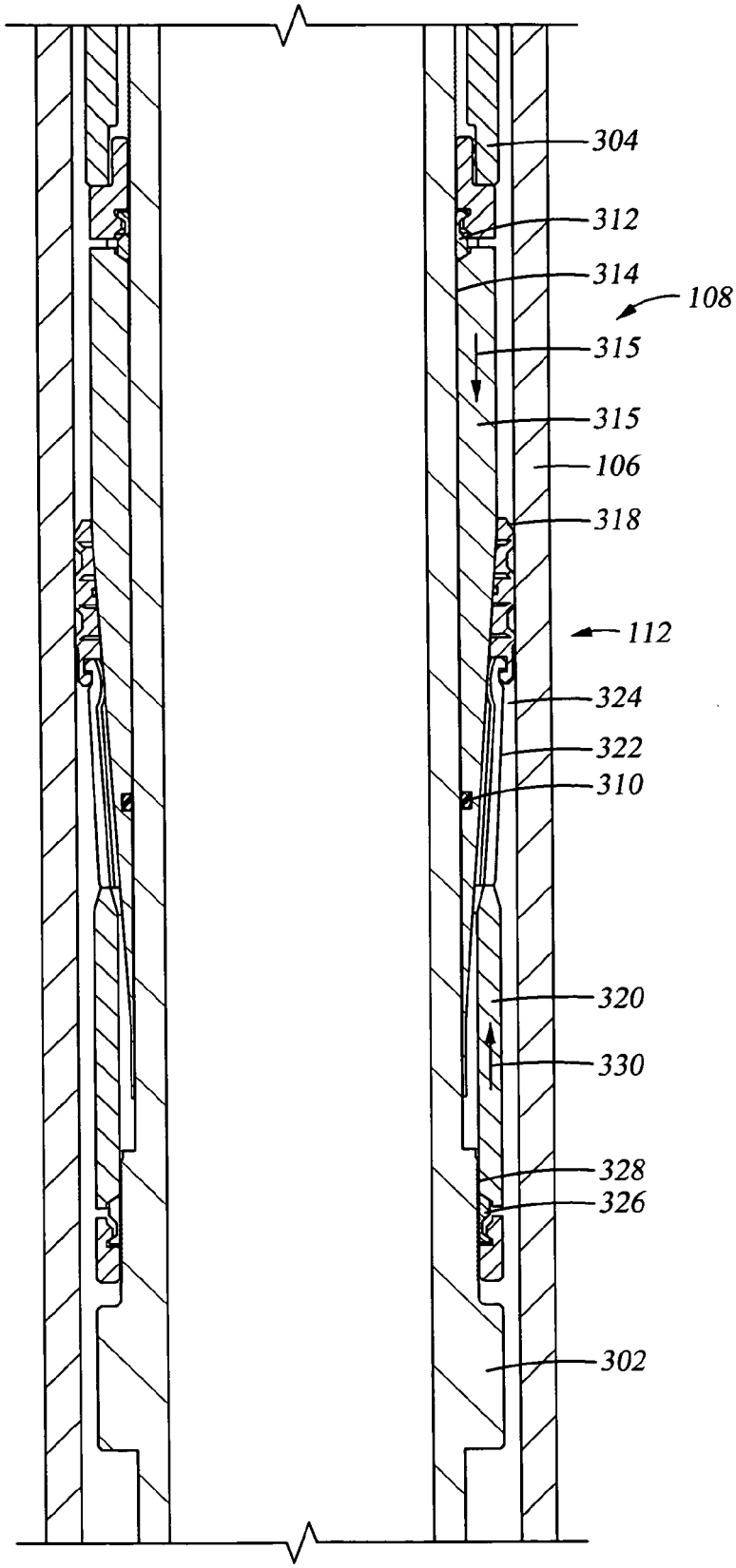
FIG. 5 shows the set packer of FIG. 4A and further shows one embodiment of a locking mechanism of the packer.

Note that in the set position the collet fingers 322 are flared radially outwardly but remain interlocked with the lip 324 formed on the packing element 318. This coupling ties the position of the retaining sleeve 320 and ratchet ring 326 to the axial position of packing element 318. This allows the packing element 318 to move up the wedge member 308 in response to increased pressure from below maintaining its tight interface with the casing I.D. but prevents relative movement of the packing element 318 in the opposite direction (shown by the arrow 315). Absent a compensating mechanism, pressure from below the packer may act to diminish the integrity of the seal formed by the packing element 318 since the interface of the packing element 318 with the casing and wedge member 308 will loosen due to pressure swelling the casing and likewise acting to collapse the wedge member 308 from under the packing element 318. One embodiment of the packer 112 counteracts such an undesirable effect by the provision of the self-adjusting locking mechanism implemented by the ratchet ring 326 and ratchet surface 328. In particular, the retaining sleeve 320 is permitted to travel up the mandrel 302 in the direction of the arrow 330 in response to a motivating force acting on the packing element 318, as shown in FIG. 5. However, the locking mechanism prevents the retaining sleeve 320 from traveling in the opposite direction (i.e., in the direction of arrow 315), thereby ensuring that the seal does not move with respect to the casing when pressure is acting from above, thus reducing wear on the packing element 318.

Figure 3B:
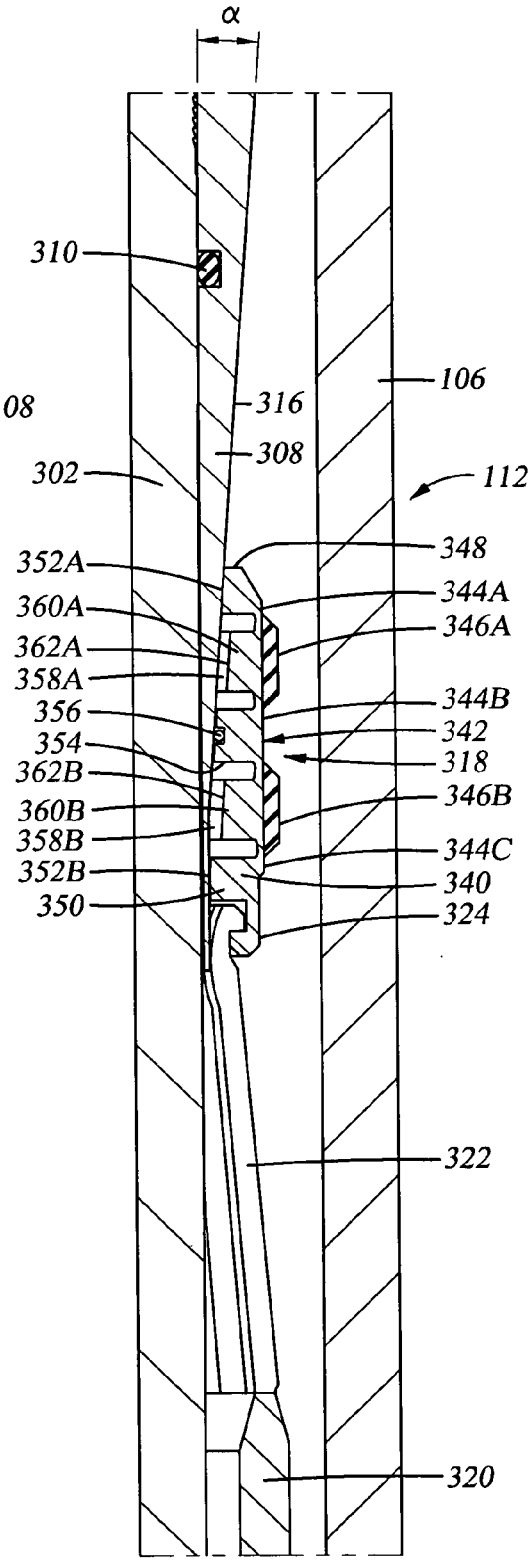
FIG. 3B is a close-up view of the packer of FIG. 3A.

Referring now to FIG. 3B, additional aspects of the packer 112, and in particular the packing element 318, will be described. FIG. 3B corresponds to the run-in position of the packer 112 shown in FIG. 3A and, therefore, shows the packing element 318 in the unset position. As such, the packing element 318 rests on the diametrically smaller end of the tapered surface 316.

The packing element 318 includes a generally tubular body 340 having a substantially smooth outer surface 342 at its outer diameter, and defining a frustoconical shaped inner diameter. In this context, a person skilled in the art will recognize that a desired smoothness of the outer surface 342 is determined according to the particular environment and circumstances in which the packing element 318 is set. For example, the expected pressures to be withstood by the resulting seal formed by the packing element 318 will affect the smoothness of the outer surface 342.

To form elastomeric seals with respect to the casing 106, the outer surface 342 carries one or more sealing elements 346A–B. The sealing elements 346A–B may be elastomer bands preferably secured to the outer surface 342 in a manner that prevents swabbing off during operation. For example, the sealing elements 346A–B may be bonded to the outer surface 342. Generally, the exposed portion of the outer surface 342 (i.e., the portion not covered by the sealing elements 346A–B) forms non-elastomer sealing surfaces 344A–C. Thus, the number and size of the sealing elements 346A–B defines the surface area of the exposed outer surface 342. Generally, any number of sealing elements 346A–B and non-elastomer sealing surfaces 344A–C may be provided. Illustratively, the packing element 318 is shown carrying two sealing elements 346A–B and defining three non-elastomer sealing surfaces 344A–C on the outer surface 342. In such a configuration, the width of each non-elastomer sealing surface 344A–C may be, for example, between about 0.1" and about 0.25". In general, a relatively narrow width of each non-elastomer sealing surface 344A–C is preferred in order to achieve a sufficient contact force between the surfaces and the casing 106.

In the depicted embodiment, the frustoconical shaped inner diameter is defined by a pair of ribs 348 and 350 at either end of the tubular body 340. The ribs 348, 350 are annular member integrally formed as part of the tubular body 340. Each rib 348, 350 forms an actuator-contact surface 352A and 352B, respectively, at the inner diameter of the tubular body 340, where the surfaces 352A–B are disposed on the tapered surface 316. In an illustrative embodiment, the tapered surface 316 has an angle ($\alpha$) of between about 2 degrees and about 6 degrees. Accordingly, the frustoconical shaped inner diameter defined by the actuator-contact surfaces 352A–B may have a substantially similar taper angle.

The tubular body 340 further includes a sealing rib 354 located between the ribs 348 and 350. In one aspect, the sealing rib 354 forms a fluid-tight seal with respect to the outer tapered surface 316 of the wedge member 308. To this end, the sealing rib 354 carries an O-ring seal 356 on its lower surface and in facing relation to the tapered surface 316. It is noted that in another embodiment, the ribs 348, 350 may also, or alternatively, carry seals at their respective inner diameters.

In another aspect, the provision of the sealing rib 354 defines a pair of voids on either side of the sealing rib 354. That is, a first void 358A is defined between the outer rib 348 and the sealing rib 354, and a second void 358B is defined by the outer rib 350 and the sealing rib 354. As will be described in more detail below, the voids 358A–B allow a degree of deformation of the tubular body 340 when the sealing element 318 is placed into a sealed position.

In one embodiment, the volumes of the voids 358A–B are limited by the presence of support members 360A–B, as shown in FIG. 3B. The support members 360A–B are generally annular members extending radially inwardly from the tubular body 340 below the sealing elements 346A–B and form actuator-contact surfaces 362A–B at their inner diameters. In operation, the support members 360A–B (and the sealing rib 354) act to limit the degree of deformation of the tubular body 340 when the sealing element 318 is placed into a sealed position. Although not shown, the surfaces 362A–B may carry O-rings to form a seal with the tapered surface 316 when the sealing element is in a sealed position.

Figure 4B:
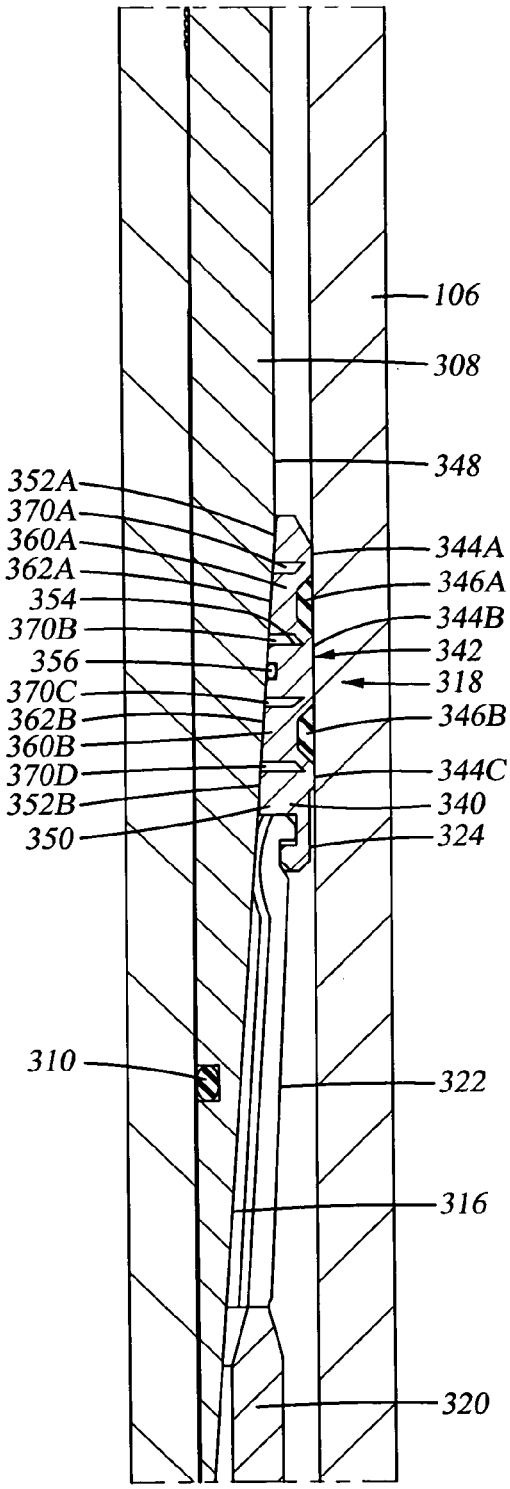
FIG. 4B is a close-up view of the packer of FIG. 4A.

Referring now to FIG. 4B, the sealing element 318 is shown in the sealed (set) position, corresponding to FIG. 4A. Accordingly, the sealing element 318 rests at the diametrically enlarged end of the tapered surface 316 and is sandwiched between the wedge member 308 and the casing 106. The dimensions of the packer 112 are preferably such that the packing element 318 is fully engaged with the casing 106, before the tubular body 340 reaches the end of the tapered surface 316. Note that in the sealed position, the tubular body 340 has been diametrically expanded and the sealing rib 354 and the support members 360A–B contact the tapered surface 316. In this position, the sealing rib 354 seals the voids 358A and 358B from one another. In addition, each void 358A and 358B is itself split into two separate annular cavities, 370A–B and 370C–D, respectively.

As such, it is clear that the tubular body 340 has undergone a degree of deformation. The process of deformation may occur, at least in part, as the packing element 318 slides up the tapered surface 316, prior to making contact with the inner diameter of the casing 106. That is, the tubular body 340 may be constructed to allow the outer surface 342 to bow inwardly under the stress of diametric expansion of the tubular body 340. Additionally or alternatively, deformation may occur as a result of contact with the inner diameter of the casing 106. In any case, the process of deformation forms a plurality of radially extended upsets on the outer surface 342 which contact the inner diameter of the casing 106 in the sealed position. In particular, upsets are formed at each of the sealing surfaces 344A–C. In this manner, the sealing surfaces form non-elastomeric backup seals for the elastomeric seals formed by the sealing elements 346A–B. In addition, the non-elastomeric backup seals prevent extrusion of the elastomeric sealing elements 346A–B. In this regard, it is noted that, in the run-in (unset) position (shown in FIG. 3B) the sealing rib 354 is preferably positioned closer to the tapered surface 316 than the support members 360A–B. In this way, the sealing rib 354 is caused to contact the tapered surface 316 before the support members 360A–B, thereby producing an upset at a location corresponding to a central sealing surface 344B of the outer surface 342.

Figure 6:
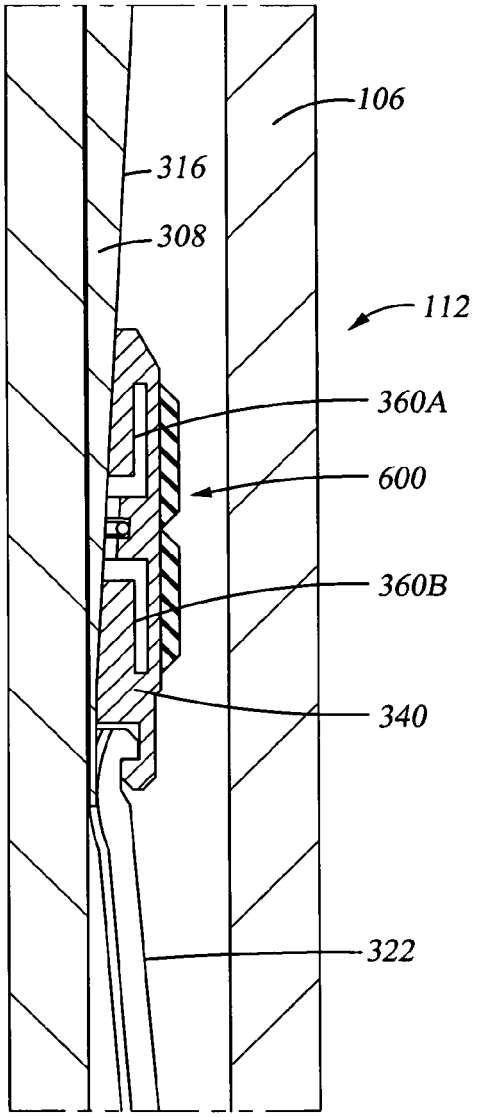
FIG. 6 is a side cross sectional view of another embodiment of the packer of FIG. 1.
Figure 7:
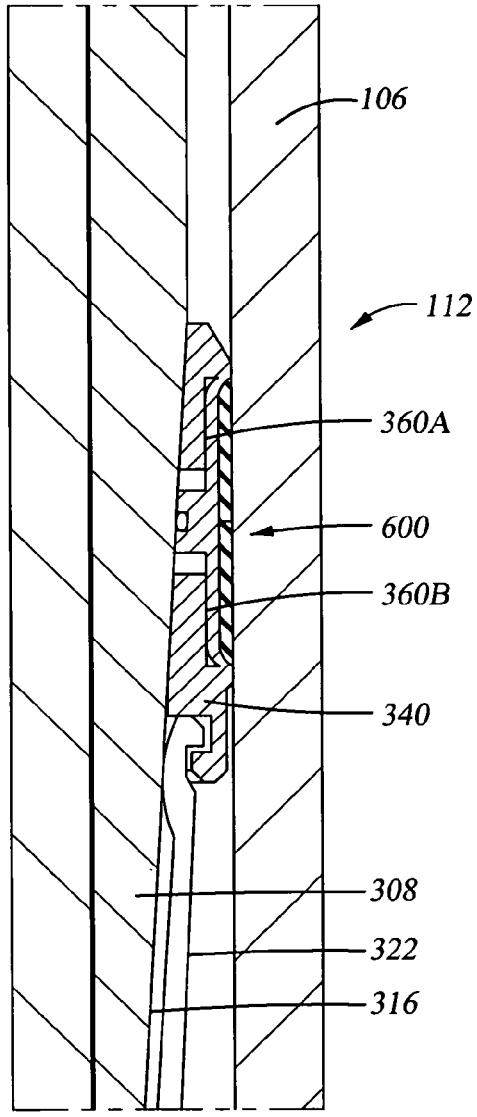
FIG. 7 is a side cross sectional view of the packer of FIG. 6 in a set position.
Figure 8:
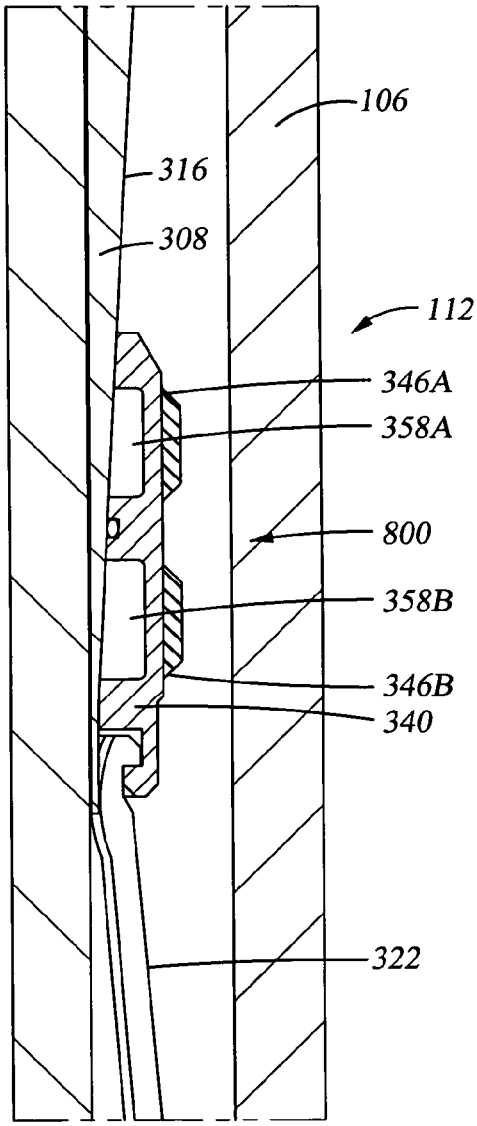
FIG. 8 is a side cross sectional view of another embodiment of the packer of FIG. 1.
Figure 9:
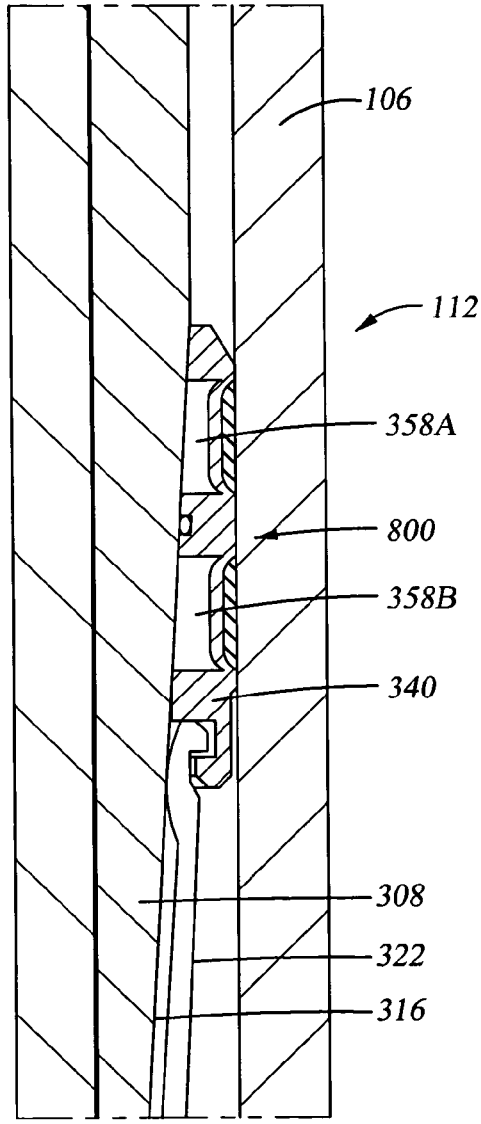
FIG. 9 is a side cross sectional view of the packer of FIG. 8 in a set position.

It is understood that the packer 112 and the related packing element shown and described with reference to FIGS. 3–5 are merely illustrative. Persons skilled in the art will recognize a variety of other embodiments within the scope of the present invention. By way of illustration, FIGS. 6–9 show alternative embodiments of the packer 112. FIGS. 6–7 show a packing element in the run-in (unset) position and the set position. FIGS. 8–9 show another packing element in the run-in (unset) position and the set position. For convenience, features of the packer 112 which are similar to those described above are identified by like reference numerals, although not all features are identified. Referring first to FIGS. 6 and 7 an embodiment of the packer 112 is shown in which a packing element 600 has support members 360A–B radially extending outwardly from the tapered surface 316 toward respective sealing elements. In this case, the lower surfaces of the tubular body 340 below the sealing elements 346A–B bow inwardly (i.e., into the respective voids 358A–B) until contacting the upper surfaces of the support members 360A–B. Referring now to FIGS. 8 and 9, an embodiment of the packer 112 is shown in which a packing element 800 is constructed without the support members 360A–B. In this case, the lower surfaces of the tubular body 340 below the sealing elements 346A–B bow inwardly (i.e., into the respective voids 358A–B) without contacting the tapered surface 316 in the set position (as shown in FIG. 9).

It is understood that the packer 112 and the related packing element shown and described with reference to FIGS. 3–9 are merely illustrative. Persons skilled in the art will recognize a variety of other embodiments within the scope of the present invention. For example, although the elements and features of the illustrative tubular body 340 are integral with one another (e.g., formed of a monolithic piece of material) it is contemplated that the tubular body 340 may be a composite of separate pieces.

While the foregoing is directed to embodiments of the present invention, other and further embodiments of the invention may be devised without departing from the basic scope thereof, and the scope thereof is determined by the claims that follow.

What is claimed is:

1. A seal ring for sealing an annular area in a wellbore, comprising:

an inner sealing surface having at least two inward radially extending ribs forming a cavity therebetween; and an outer sealing surface including at least one raised, elastomeric sealing element, the element disposed on the outer sealing surface opposite the cavity whereby, when the sealing element is compressed, the outer surface is deformed in the area of the sealing element at the cavity.

2. The seal ring of claim 1, wherein the inner sealing surface further includes an inward radially extending support member along an area of the cavity to limit an amount that the outer surface can be deformed.

3. The seal ring of claim 1, wherein the cavity is dimensioned to limit an amount that the outer surface can be deformed.

4. The seal ring of claim 1, wherein the inner sealing surface defines a frustoconical inner diameter.

5. A packer for a downhole sealing operation, comprising:

a tubular body having an outer surface, along at least part of the tubular body, that is substantially smooth and cylindrical in an unset position of the packer; and an elastomeric sealing element disposed on the outer surface, wherein the tubular body is shaped to define a void under the sealing element to enable deformation of a first portion of the outer surface into the void relative to an adjacent second portion of the outer surface in a set position of the packer.

6. The packer of claim 5, wherein the void is provided by a recess along an inner surface of the tubular body.

7. The packer of claim 5, wherein the void is provided by a recess along an inner surface of the tubular body, the recess having a relatively less deep center area defining a support member that limits the deformation.

8. The packer of claim 5, wherein the void is provided by a cavity within the tubular body.

9. The packer of claim 5, wherein the void is provided by a cavity within the tubular body, the cavity dimensioned to limit the deformation.

10. The packer of claim 5, wherein an inner surface of the tubular body defines a frustoconical inner diameter.

11. The packer of claim 5, further comprising a seal ring disposed along an inner surface of the tubular body.

12. The packer of claim 5, further comprising a tubular wedge member disposed in a central opening of the tubular body, wherein an inner surface of the tubular body defines a frustoconical inner diameter and is disposed on an outer Inclined actuation surface of the tubular wedge member.

13. The packer of claim 5, further comprising:

a mandrel; and a tubular wedge member slidably disposed about the mandrel and disposed in a central opening of the tubular body, wherein an inner surface of the tubular body defines a frustoconical inner diameter and is disposed on an outer inclined actuation surface of the tubular wedge member.

14. The packer of claim 5, wherein the elastomeric sealing element is disposed on the first portion of the outer surface leaving exposed the second portion and a third portion of the outer surface on each side of the first portion, wherein the tubular body is shaped to define the void under the sealing element to enable deformation of the first portion of the outer surface into the void relative to the second and third portions of the outer surface in the set position of the packer.

15. A method of forming a seal in a wellbore, comprising:

providing a packer comprising a non-elastomeric tubular body running the packer into the wellbore; and diametrically expanding the tubular body causing a first outer surface portion of the tubular body to contact a surrounding surface and an adjacent second outer surface portion of the tubular body to deform inward and recess into a void created by a shape of the tubular body.

16. The method of claim 15, wherein diametrically expanding the tubular body to cause deformation comprises causing a section of the tubular body on which the second outer surface portion is defined and on which a raised, elastomeric sealing element is disposed to recess into a cavity created between two inward radially extending ribs along an inner surface of the tubular body.

17. The method of claim 15, wherein the contact of the first outer surface portion with the surrounding surface forms a non-elastomeric seal.

18. The method of claim 15, wherein the second outer surface portion of the tubular body deforms inward upon compressing an elastomeric sealing element disposed on the second outer surface portion against the surrounding surface.

19. The method of claim 15, wherein diametrically expanding the tubular body comprises moving the tubular body relative to a tubular wedge member such that a frustoconical inner diameter of the tubular body slides up an outer inclined actuation surface of the tubular wedge member.

20. A sealing assembly for use in a wellbore sealing operation, comprising:

a tubular member having an outer surface that is cylindrical along at least part of the tubular member when the sealing assembly is in an unset position; and a sealing element disposed on the outer surface, wherein the tubular member is shaped to define a void under the sealing element to enable deformation of a first portion of the outer surface into the void relative to an adjacent second portion of the outer surface when the sealing assembly is in a set position.

21. The sealing system of claim 20, further comprising a seal ring disposed along an inner surface of the tubular member.

22. The sealing system of claim 20, wherein the void is provided by a cavity within the tubular member, the cavity configured to limit the deformation.

23. The sealing system of claim 20, wherein the void is provided by a recess along an inner surface of the tubular member.

* * * * *